US006935710B2

(12) United States Patent
Chen et al.

(10) Patent No.: US 6,935,710 B2
(45) Date of Patent: Aug. 30, 2005

(54) TWO-WAY RETAINER FOR A SLIDE TRACK ASSEMBLY OF DRAWERS

(75) Inventors: Ken-Ching Chen, Kaohsiung Hsien (TW); Shih-Long Hwang, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 97 days.

(21) Appl. No.: 10/438,973

(22) Filed: May 16, 2003

(65) Prior Publication Data

US 2004/0174100 A1 Sep. 9, 2004

(30) Foreign Application Priority Data

Mar. 5, 2003 (TW) ..... 92203447 U
Apr. 15, 2003 (TW) ..... 92206231 U

(51) Int. Cl.[7] ..... A47B 88/04
(52) U.S. Cl. ..... 312/333; 312/334.44
(58) Field of Search ..... 312/330.1, 333, 312/334.1, 334.7, 334.8, 334.12, 334.44, 334.46, 334.47; 384/21

(56) References Cited

U.S. PATENT DOCUMENTS 4,749,242 A * 6/1988 Rechberg ..... 312/333
6,367,899 B1 * 4/2002 Hwang et al. ..... 312/334.47
6,412,891 B1 * 7/2002 Liang et al. ..... 312/334.44
2003/0141791 A1 * 7/2003 Dubon et al. ..... 312/333

FOREIGN PATENT DOCUMENTS

DE 4210017 * 10/1992

* cited by examiner

*Primary Examiner*—James O. Hansen
(74) *Attorney, Agent, or Firm*—Bacon & Thomas, PLLC

(57) ABSTRACT

A two-way retainer for a slide track assembly comprises a retaining mechanism mounted on a first slide track, and a stop member mounted on a second slide track. The retaining mechanism is consisted of a pair of retaining arms and an elastic member. The retaining arms are provided with a pair of oppositely inclined portions and a pair of engaging portions. The stop member is provided with a protrusion adapted to interact with the oppositely inclined portions and the engaging portions of the retaining arms. When the first slide track is moved to a predetermined position with respect to the second slide track, the protrusion of the stop member may pass through one of the inclined portions of the retaining arms. Thus the protrusion is confined within the two engaging portions of the retaining arms to thereby retain the first slide track in a two-way direction of the second slide track.

16 Claims, 12 Drawing Sheets

TWO-WAY RETAINER FOR A SLIDE TRACK ASSEMBLY OF DRAWERS

BACKGROUND OF THE INVENTION

1. Field of the Invention

The present invention is related to a two-way retainer for a slide track assembly of drawers. More particularly, the present invention is related to a retaining mechanism mounted on a first slide track, and a stop member mounted on a second slide track adapted to retain the first slide track in a two-way direction.

2. Description of the Related Art

Referring to FIG. 14, a conventional three-section slide track for a drawer includes a first slide track (so-called outer slide track) 30, a second slide track (so-called medium track) 20 and a third slide track (so-called inner track) 10. A ball track 40 is sandwiched in between any two of the first slide track 30, the second slide track 20 and the third slide track 10 so as to smoothen sliding movement. Moreover, the first slide track 30 and the second slide track 20 mount a retaining member 301 and a stop member 201 respectively for retaining in a one-way direction. The retaining member 301 is attached to an inner surface of the first slide track 30, and provided with an engaging portion 302. The stop member 201 is mounted to a front end of the second slide track 20, and provided with a protrusion 202. To prevent taking apart by accident, when users draws out the first slide track 30 from the second slide track 20, the protrusion 202 of the stop member 201 is engaged with the engaging portion 302 of the retaining member 301 in place.

Users can draw out a keyboard or a component, which is attached to the first slide track 30, for servicing. Although the engagement of the stop member 201 with the engaging portion 302 can avoid releasing the first slide track 30 from the second slide track 20 by accident, it cannot prevent the first slide track 30 retracting into the second slide track 20 by careless force of users. Therefore, it is inconvenient to users for operating the slide tracks in use.

Applicant own U.S. Pat. Nos. 6,367,899 and 6,412,891 are provided with a mechanism to overcome this problem and incorporated herein by reference.

The present invention also intends to provide a two-way retainer for a slide track assembly, which comprises a retaining mechanism mounted on a first slide track, and a stop member mounted on a second slide track. The retaining mechanism is consisted of a pair of retaining arms, and each of the retaining arms is formed with an inclined portion and an engaging portion for selectively engaging or disengaging with or from the stop member in such a way to mitigate and overcome the above problem.

SUMMARY OF THE INVENTION

The primary objective of this invention is to provide a two-way retainer for a slide track assembly of drawers, which comprises a retaining mechanism mounted on a first slide track, and a stop member mounted on a second slide track. The retaining mechanism is consisted of a pair of retaining arms, and each of the retaining arms is formed with an inclined portion and an engaging portion for selectively engaging or disengaging with or from the stop member, thereby increasing useful convenience.

The two-way retainer for a slide track assembly of drawers in accordance with the present invention comprises a retaining mechanism mounted on a first slide track, and a stop member mounted on a second slide track. The retaining mechanism is consisted of a pair of retaining arms and an elastic member. The retaining arms are provided with a pair of oppositely inclined portions and a pair of engaging portions. The stop member is provided with a protrusion adapted to interact with the oppositely inclined portions and the engaging portions of the retaining arms. When the first slide track is moved to a predetermined position with respect to the second slide track, the protrusion of the stop member may pass through one of the inclined portions of the retaining arms. Thus the protrusion is confined within the two engaging portions of the retaining arms to thereby retain the first slide track in a two-way direction of the second slide track.

Other objectives, advantages and novel features of the invention will become more apparent from the following detailed description and the accompanying drawings.

BRIEF DESCRIPTION OF THE DRAWINGS

The present invention will now be described in detail with reference to the accompanying drawings herein.

DETAILED DESCRIPTION OF THE INVENTION

Figure 1:
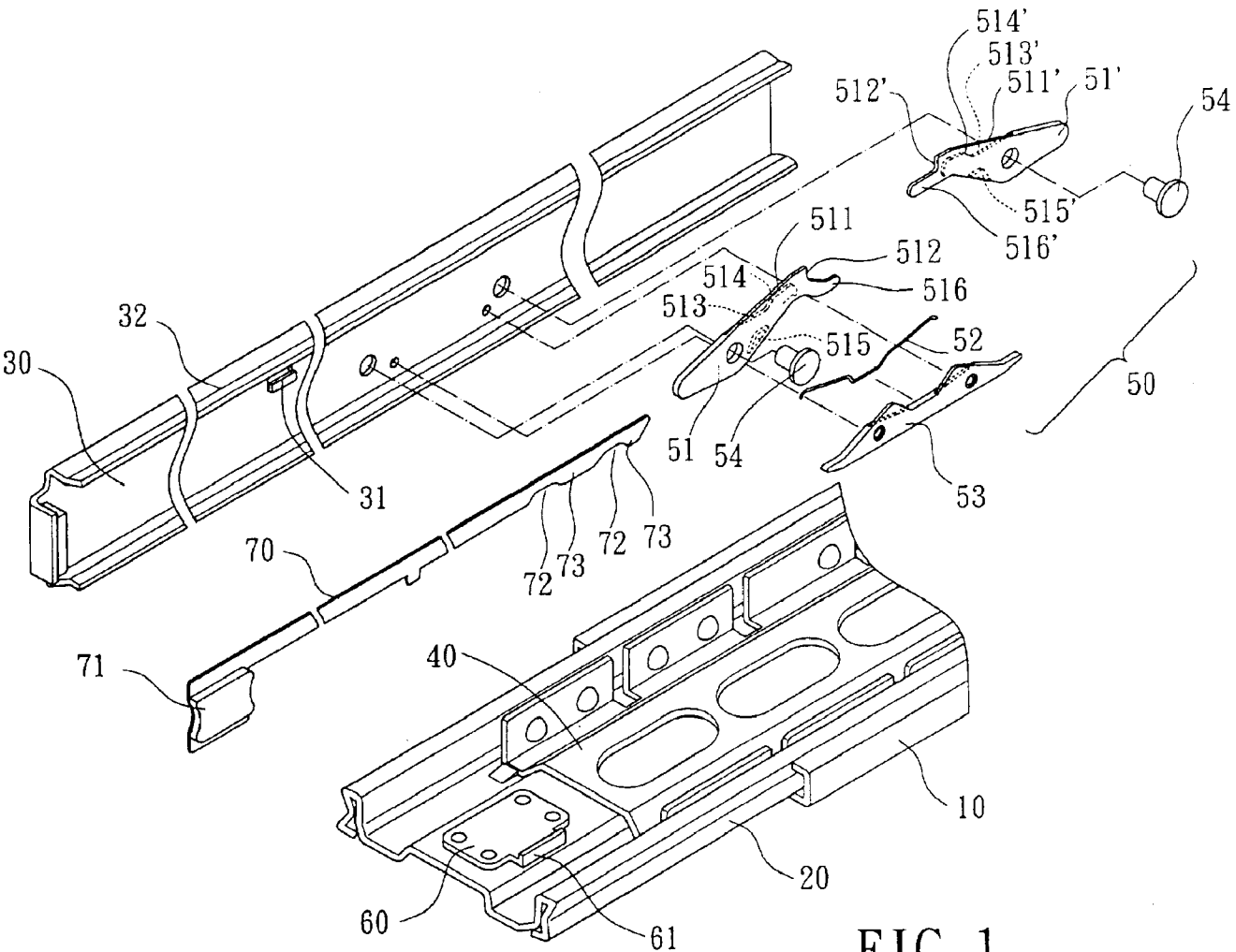
FIG. 1 is an exploded perspective view of a two-way retainer for a slide track assembly of drawers in accordance with a first embodiment of the present invention.

Referring to FIGS. 1 through 13, reference numerals of the embodiments have applied the identical numerals of the conventional slide track assembly. The slide track assembly of the embodiment has the similar configuration and same function as the conventional slide track assembly and the detailed descriptions are omitted.

Figure 2:
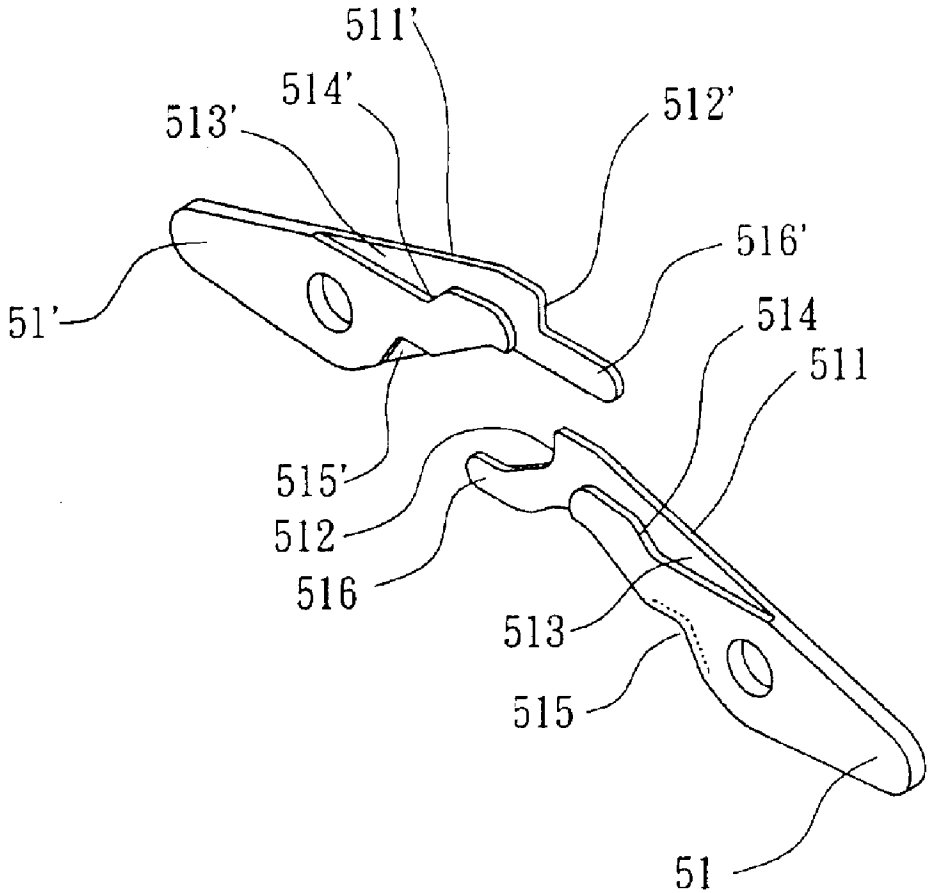
FIG. 2 is an exploded perspective view of a pair of retaining arms applied to the two-way retainer for a slide track assembly of drawers in accordance with the first embodiment of the present invention.
Figure 3:
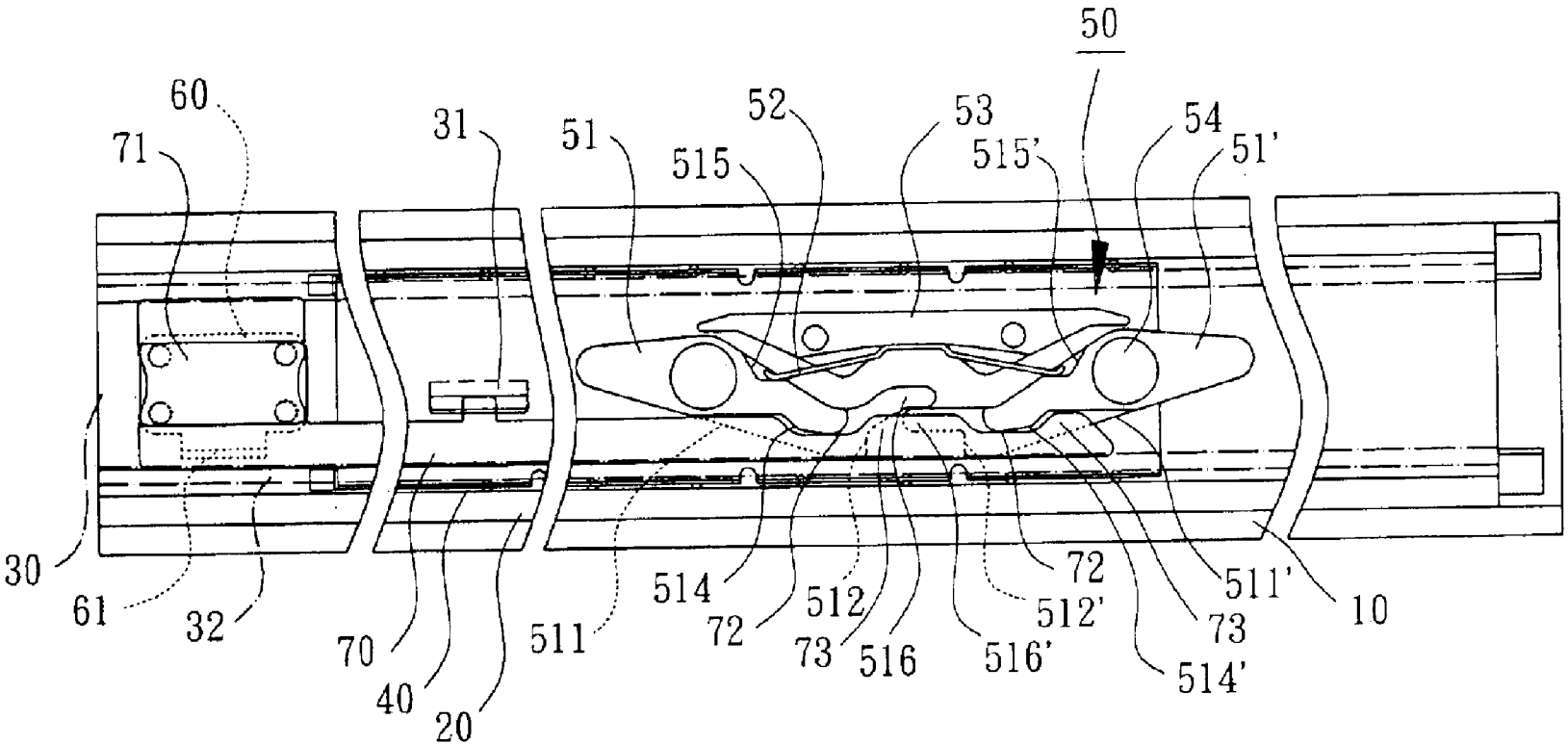
FIG. 3 is a lateral view of the two-way retainer for a slide track assembly of drawers in accordance with the first embodiment of the present invention mounted to the slide track assembly.
Figure 4:
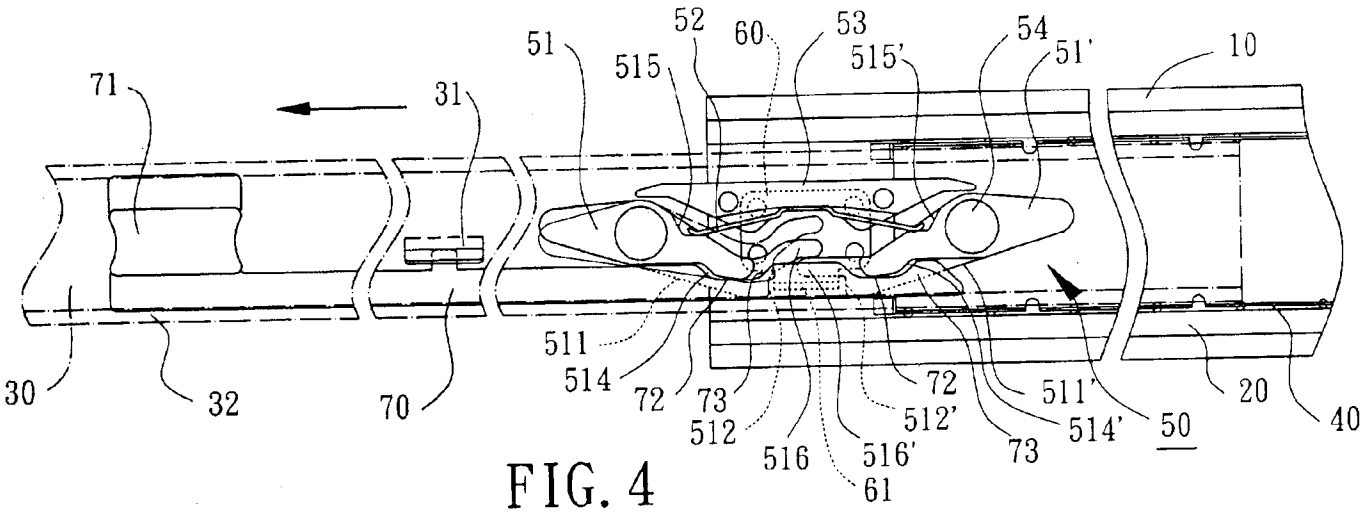
FIG. 4 is a lateral view of a retaining operation of the two-way retainer in accordance with the first embodiment of the present invention at a predetermined position of a first slide track of the slide track assembly.

Referring to FIGS. 1 through 3, a two-way retainer for a slide track assembly of drawers in accordance with a first embodiment of the present invention comprises a retaining mechanism 50, a stop member 60 and an unlatching member 70. The retaining mechanism 50 and the unlatching member 70 are mounted at an appropriate position of an inner side of the first slide track 30 while the stop member 60 mounting to an end of the second slide track 20. Ball tracks 40 are sandwiched in between any two of the first slide track 30, the second slide track 20 and the third slide track 10.

Referring again to FIGS. 1 through 3, the retaining mechanism 50 comprises a pair of retaining arms 51, 51', an elastic member 52, a base 53 and a pivotal member 54. Each of the retaining arms 51, 51' includes an inclined portion 511, 511', a first engaging portion 512, 512', a step portion 513, 513', a second engaging portion 514, 514' and a recession 515, 515'. The elastic member 52 is adapted to bias the retaining arms 51, 51'. The base 53 is adapted to position the elastic member 52 on the inner side of the first slide track 30 and thereby the elastic member 52 is located between the retaining arms 51, 51'. The pivotal member 54 is adapted to pivotally connect the opposite retaining arms 51, 51' to the first slide track 30. Moreover, the inclined portion 511, 511' of the retaining arm 51, 51' is pushed by the stop member 60 and turned. The two first engaging portions 512, 512' are arranged face to face each other, thereby forming a retaining space. The step portion 513, 513' is recessed on the retaining arm 51, 51' for allowing adequate operation of the unlatching member 70, and faced the side surface of the first slide track 30. The second engaging portion 514, 514' is formed on an appropriate position of the step portion 513, 513' and adapted to engage with one of shoulders 73 of the unlatching member 70 for rotational operation. The recession 515, 515' is adapted to engage with two ends of the elastic member 52.

Referring again to FIGS. 1 through 3, the stop member 60 is located at the end of the second slide track 20, provided with a protrusion 61 extended to first slide track 30. The protrusion 61 is adapted to push the inclined portion 511, 511' of the retaining arm 51, 51' for rotational operation, or to be confined within the space formed by the two first engaging portions 512, 512'.

Referring again to FIGS. 1 and 3, the unlatching member 70 is movably attached to the first slide track 30, and connected thereto by at least one holder 31. The unlatching member 70 includes a grip 71, two recessions 72 and two shoulders 73. An operator can hold the grip 71 to pull backward or to push forward for unlatching an engaged relationship of the first engaging portion 512, 512' of the retaining arm 51, 51' with the protrusion 61 of the stop member 60. Locating in the step portions 513, 513' of the retaining arms 51, 51' the two recessions 72 are engaged with the second engaging portions 514, 514'. The two shoulders 73 are adjacent to two rear edges (or front edges) of the two recessions 72, and adapted to push the second engaging portions 514, 514' for rotational operation of the retaining arms 51, 51' when an operator pulls backward or pushes forward the unlatching member 70.

Referring again to FIG. 3, firstly, the retaining mechanism 50 is pivotally connected to the first slide track 30. The first slide track 30, the second slide track 20 and the third slide track 10 are nested when assembled. Then the retaining arms 51, 51' are biased by the elastic member 52 and turned to confront with a flange 32 of the first slide track 30. An end of the unlatching member 70 is extended into the step portions 513, 513' of the retaining arms 51, 51' so that the two recessions 72 are closely engaged with the two engaging portions 514, 514'.

Referring again to FIG. 4, one of the retaining arms 51, 51' comes to contact with the protrusion 61 of the stop member 60 mounted on the second slide track 20 while the first slide track 30 moving to a predetermined position of the second slide track 20. Once the protrusion 61 presses the inclined portion 511, the retaining arm 51 turns an angular length counterclockwise. Subsequently, the protrusion 61 may pass through one of the retaining arms 51 and confront with the first engaging portion 512' of the other retaining arm 51' that obstructs any further movement of the protrusion 61. The retaining arms 51, 51' may return the original positions due to a bias force of the elastic member 52. Consequently, the protrusion 61 is confined within a space formed by the two first engaging portions 512, 512' of the retaining arms 51, 51' so that the first slide track 30 is able to retain in a two-way direction on the second slide track 20.

Figure 5:
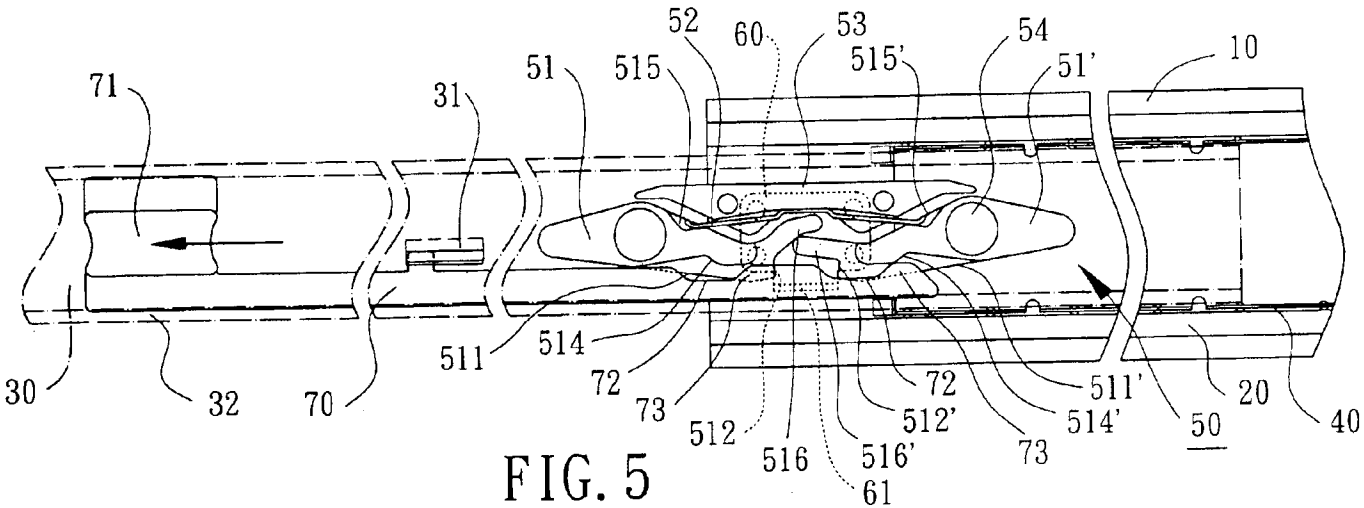
FIG. 5 is a lateral view of a releasing operation of an unlatching member for actuating the two-way retainer in accordance with the first embodiment of the present invention.
Figure 6:
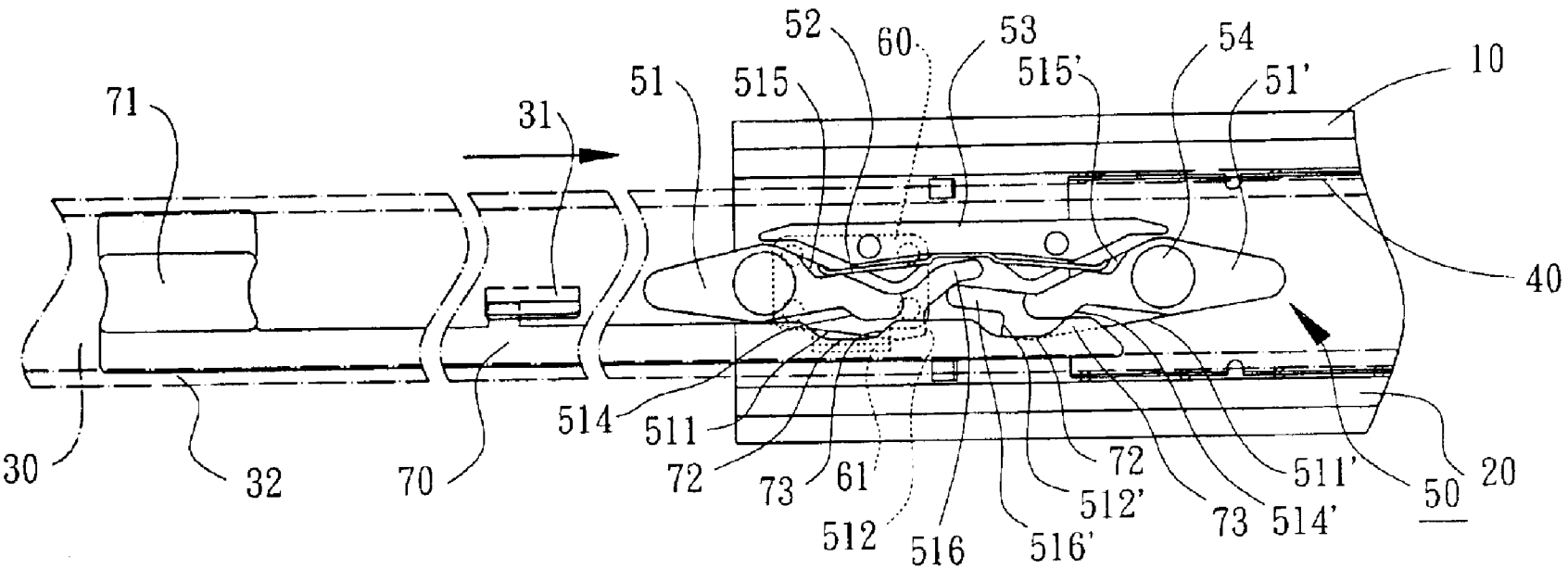
FIG. 6 is a lateral view of the two-way retainer in accordance with the embodiment of the present invention in the first slide track retracted into a second slide track.

Referring to FIGS. 5 and 6, the first slide track 30 is able to retract into or remove from the second slide track 20 if desired. An operator can pull backward or push forward the grip 71 of the unlatching member 70 so that the two shoulders 72 may engage with the two second engaging portions 514, 514'. Subsequently, the two retaining arms 51 are turned toward the flange 32 of the first slide track 30. An operator can disengage the two-way engaged relationship of the protrusion 61 from the retaining arms 51, 51'. Therefore, the first slide track 30 is able to retract into or remove from the second slide track 20. Once the operator release the unlatching member 70, the two retaining arms 51, 51' may return to their original positions (an operable state) by a bias force of the elastic member 52.

Referring again to FIGS. 1 through 3, each of the retaining arms 51, 51' further includes an extension 516, 516'. To accomplish synchronous operation, the two extensions 516, 516' are engaged and turned together so that the unlatching member 70 only have to provide with only one shoulder 73 to engage with one of the second engaging portions 514' of the retaining arms 51'. In unlatching operation, the unlatching member 70 is adapted to pull one of the retaining arms 51 and its extension 516 may actuate the other extension 516' of the other retaining arm 51'.

In a preferred design choice, the protrusion 61 of the stop member 60 is preferably integrated into an end of the second slide track 20 by punching the protrusion 61 on the second slide track 20.

In another design choice, the retaining mechanism 50 may preferably omit the base 53 which is replaced by mounting the elastic member 52 to the first slide track 30.

In another design choice, the unlatching member 70 is preferably combined with an elastic member (not shown) adapted to insure reciprocation on the first slide track 30.

Figure 7:
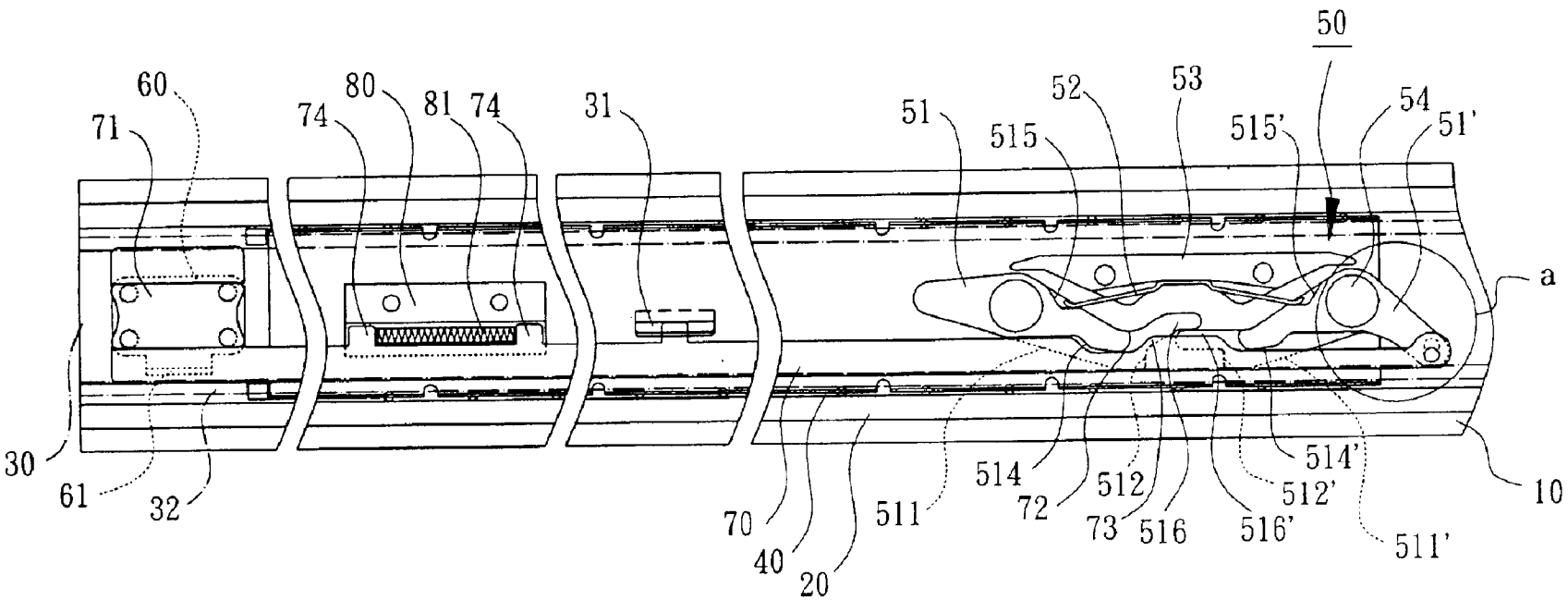
FIG. 7 is a lateral view of a two-way retainer for a slide track assembly of drawers in accordance with a second embodiment of the present invention mounted to the slide track assembly.

Referring to FIG. 7, a two-way retainer for a slide track assembly of drawers in accordance with a second embodiment of the present invention further includes an unlatching member 70 and a holder 80 adapted to hold a rod body of the unlatching member 70. To accomplish reciprocating operation, the unlatching member 70 is provided with at least one lug 74 and engaged with an elastic member 81 of the holder 80.

In another design choice, an end of the unlatching member 70 is mechanically connected to an end of the retaining arm 51' which is oppose to the first engaging portion 512' (shown at "circle a" in FIG. 7). In unlatching operation, the retaining arm 51' may be pivoted on the pivotal member 54 by the unlatching member 70, and an engaged relationship of the retaining arm 51' may actuate the other retaining arm 51 synchronously. Then the retaining arms 51, 51' are disengaged from the stop member 60 that accomplishes the same unlatching function.

In another design choice, the retaining members 51 are designed to omit the elastic member 52 and the base 53, and replaced by combining an elastic member 81 with the unlatching member 70 that may provide with a bias force to turn and return the retaining members 51, 51'.

Preferably, the two-way retainer for the slide track assembly of the drawers in accordance with the present invention is applied to a two-section slide track or the likes.

Each of the two-way retainers of the first and second embodiments employs a single unlatching member 70 having a pair of shoulders 73 to actuate the second engaging portions 514, 514' that may accomplish unlatching function. Alternatively, the shoulders 73 of the single unlatching member 70 are adapted to actuate an engaged relationship of the two extensions 516, 516' for unlatching. Consequently, the first slide track 30 can be moved along the second slide track 20 in a two-way direction or drawn out from the second slide track 20.

Figure 8:
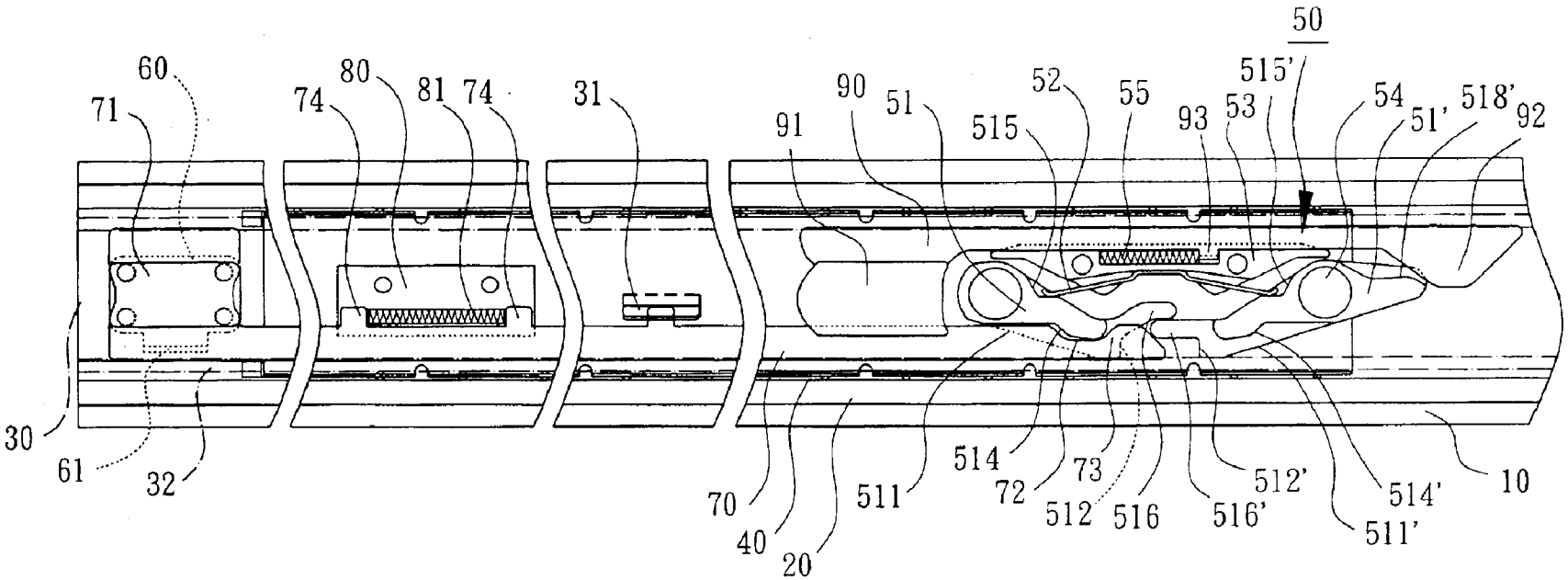
FIG. 8 is a lateral view of a two-way retainer for a slide track assembly of drawers in accordance with a third embodiment of the present invention mounted to the slide track assembly.
Figure 9:
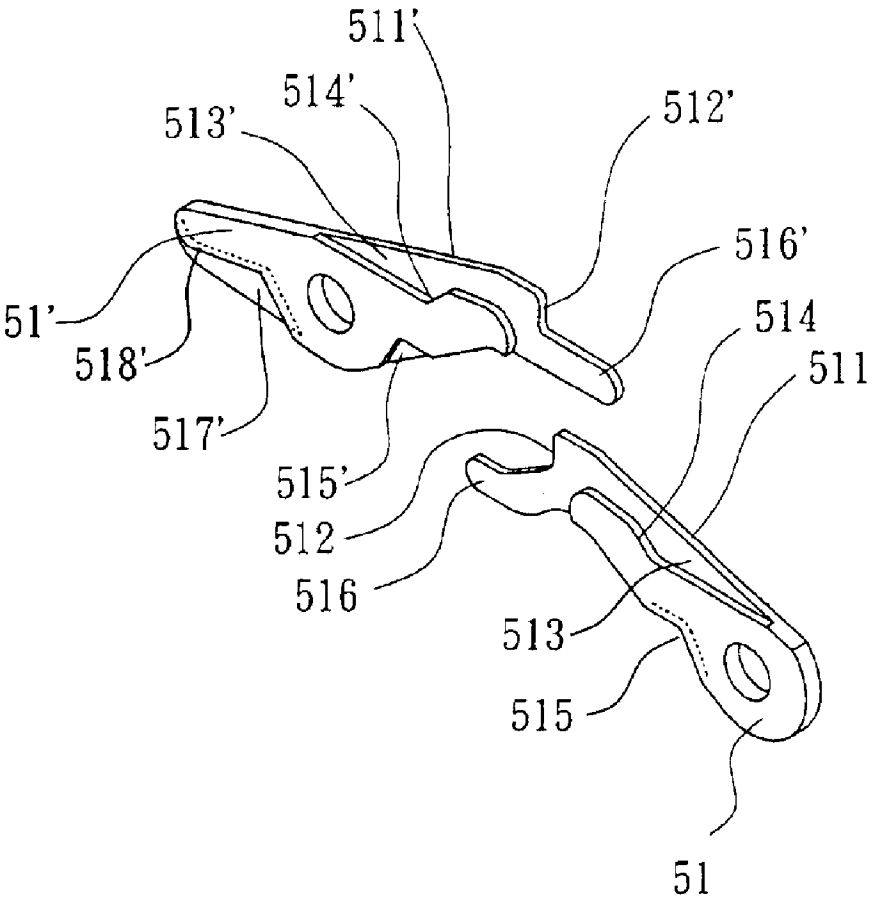
FIG. 9 is an exploded perspective view of a pair of retaining arms applied to the two-way retainer for a slide track assembly of drawers in accordance with the third embodiment of the present invention.
Figure 10:
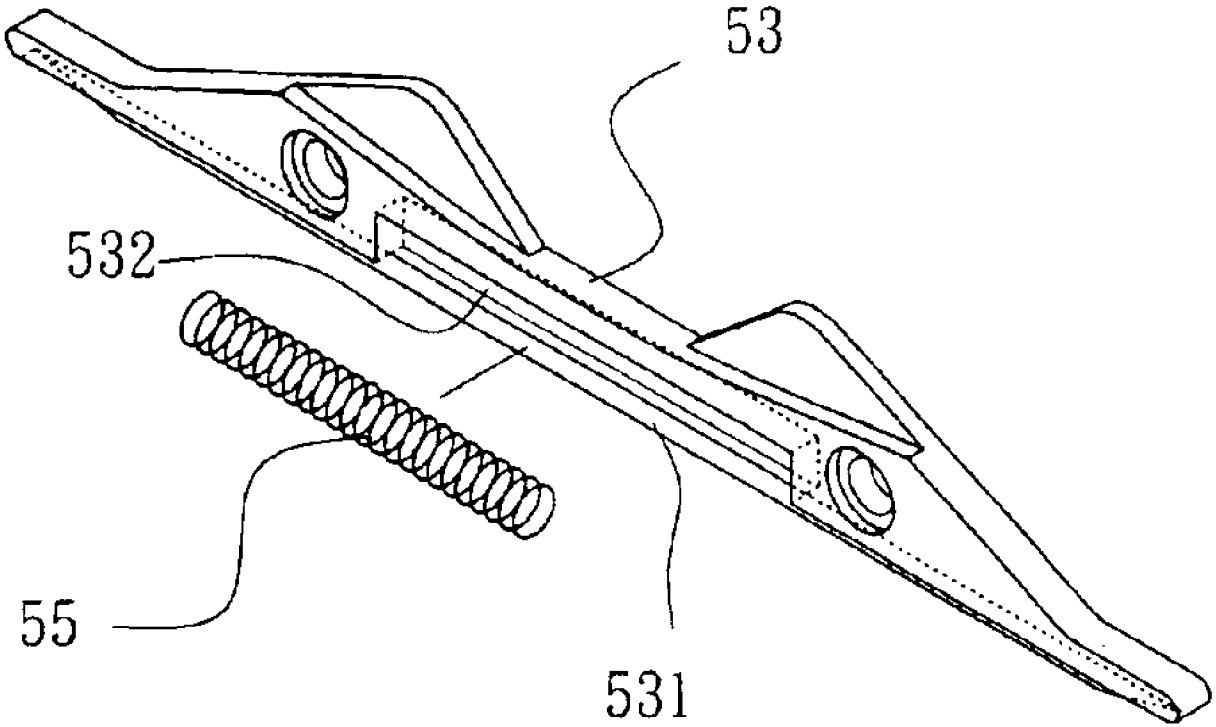
FIG. 10 is an exploded perspective view of a base and an elastic member applied to the two-way retainer for a slide track assembly of drawers in accordance with the third embodiment of the present invention.

Referring to FIGS. 8 and 9, a two-way retainer for a slide track assembly of drawers in accordance with a third embodiment of the present invention further includes a first unlatching member 70 and a second unlatching member 90. In comparison with the first and second embodiments, the first unlatching member 70 of the third embodiment includes only one recession 72 and one shoulder 73 thereof adapted to engage with the second engaging portion 514 of the retaining arm 51. Correspondingly, the unlatching member 90 includes a grip 91 and a shoulder 92. The retaining arm 51' is further provided with a step portion 517' adapted to accommodate the shoulder 92, and a third engaging portion 518 adapted to engage with the shoulder 92. Meanwhile, the base 53 is provided with a groove 531 in which to accommodate an elastic member 55. To accomplish reciprocating operation, the second unlatching member 90 is further provided with a lug 93 for engaging with the elastic member 55.

Figure 11:
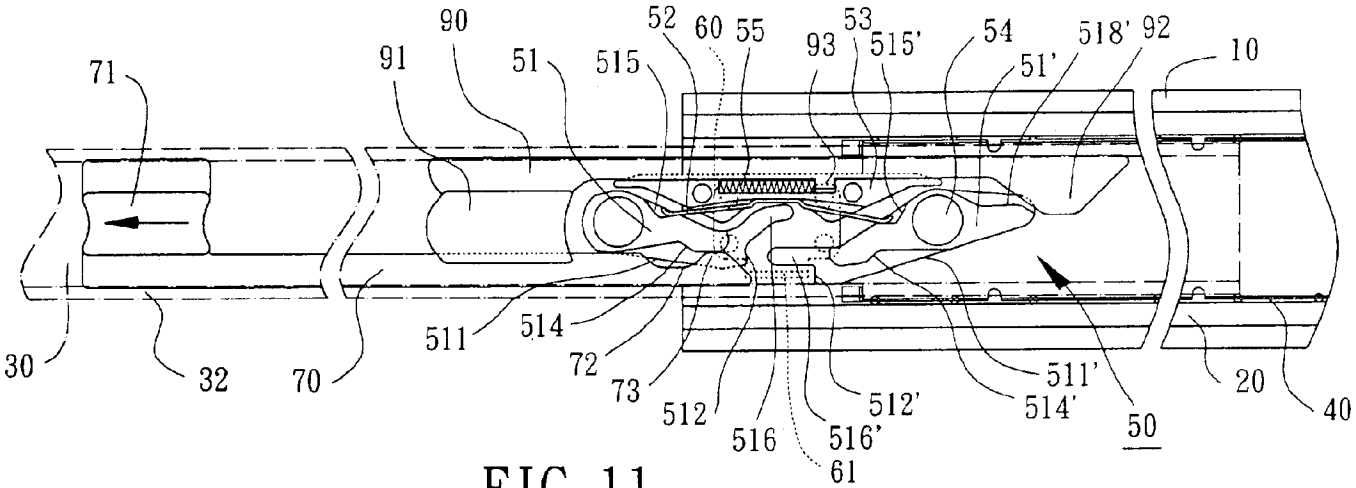
FIG. 11 is a lateral view of a releasing operation of a first unlatching member for actuating the two-way retainer in accordance with the third embodiment of the present invention.

Referring again to FIG. 8, no connected operation exists between the first unlatching member 70 and the second unlatching member 90 for actuating the retaining arms 51, 51'. Referring to FIG. 11, in retracting operation, the shoulder 73 of the first unlatching member 70 may partially actuate the second engaging portion 514 of the retaining arm 51 so that the engagement of the protrusion 61 of the stop member 60 with the retaining arm 51 may be unlatched. This allows the first slide track 30 being retracted into the second slide track 30. In this circumstance, the engagement of the protrusion 61 of the stop member 60 with the retaining arm 51' may still be maintained so that the first slide track 30 is unable to draw out from the second slide track 20. When user pulls the unlatching member 70 backward for disengaging the retaining arm 51 from the protrusion 61, the first slide track 30 may not be drawn out or released from the second slide track 20 by accident.

Figure 12:
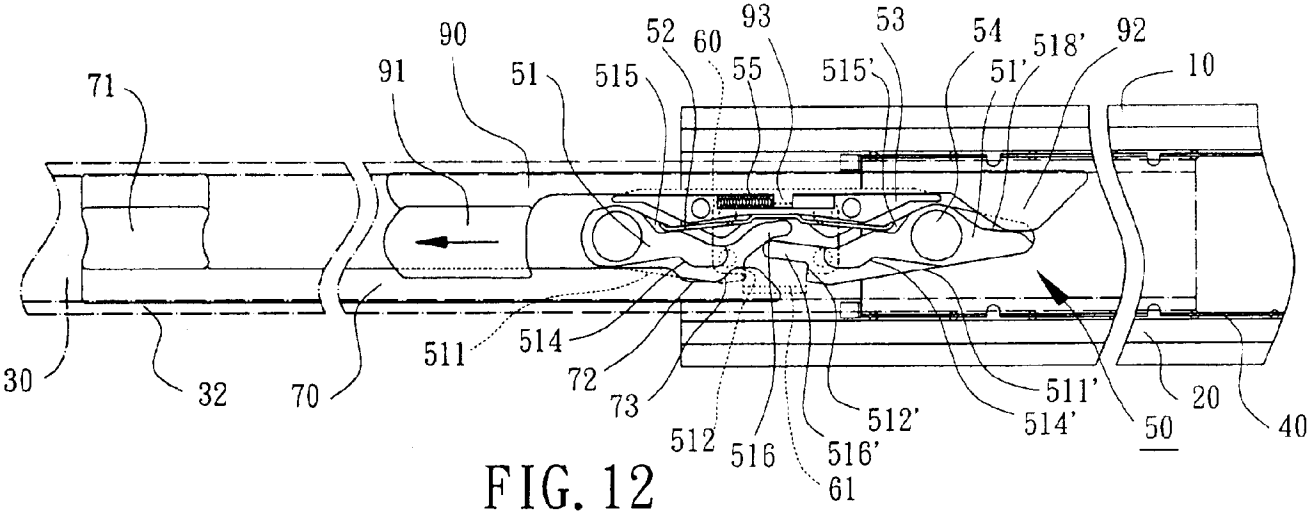
FIG. 12 is a lateral view of a releasing operation of a second unlatching member for actuating the two-way retainer in accordance with the third embodiment of the present invention.

Referring to FIG. 12, in drawing operation, the shoulder 92 of the second unlatching member 90 may partially actuate the third engaging portion 518' of the retaining arm 51' so that the extension 516' of the retaining arm 51' may actuate the other extension 516 of the retaining arm 51. At this circumstance, the engagement of the protrusion 61 of the stop member 60 with the retaining arms 51, 51' may be unlatched in a two-way direction for allowing the first slide track 30 able to move backward or forward.

Figure 13:
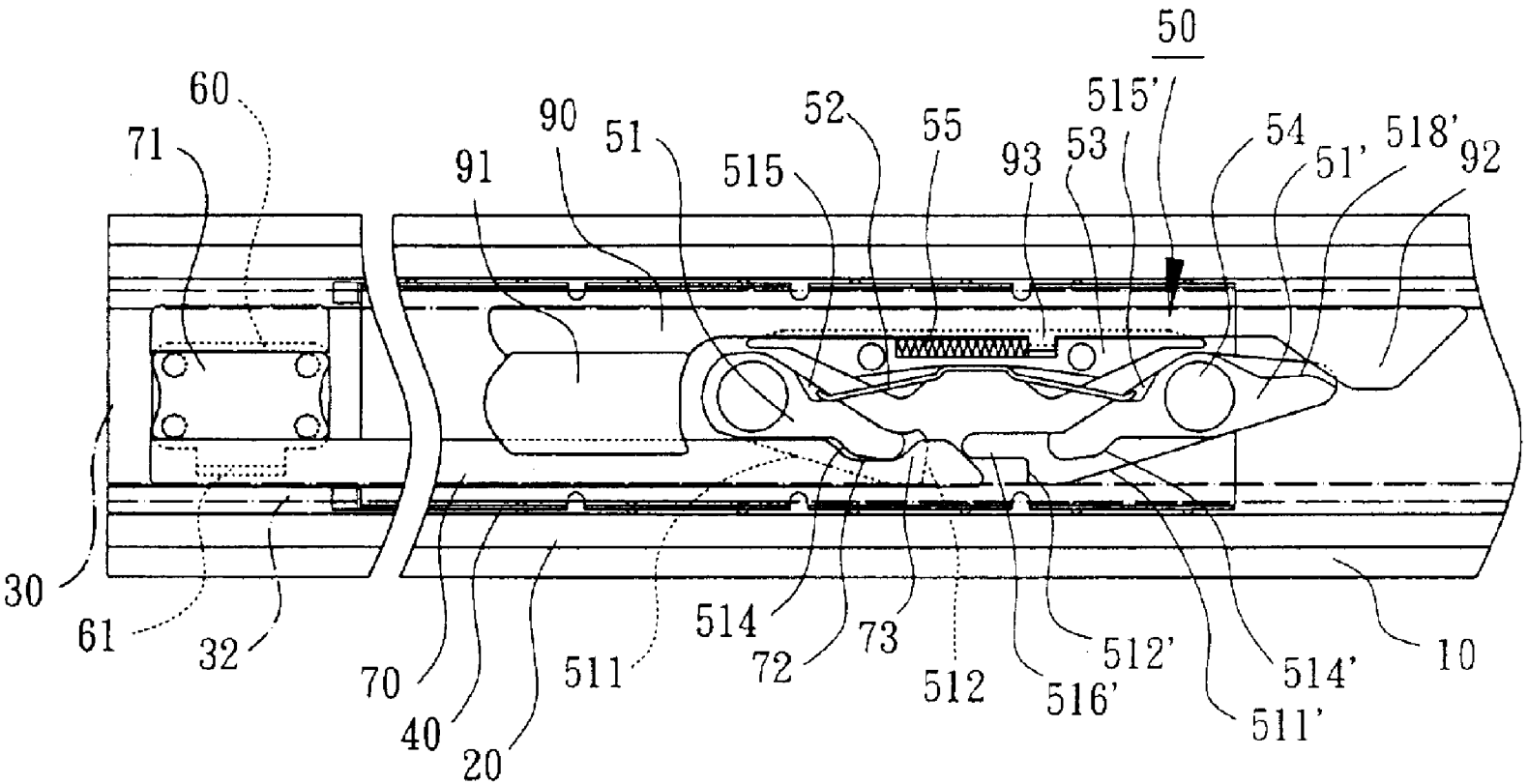
FIG. 13 is a lateral view of a two-way retainer for a slide track assembly of drawers in accordance with a fourth embodiment of the present invention mounted to the slide track assembly.

Referring to FIG. 13, a two-way retainer for a slide track assembly of drawers in accordance with a fourth embodiment of the present invention further includes a first unlatching member 70 and a second unlatching member 90. In comparison with the first through third embodiments, the retaining arms 51, 51' of the fourth embodiment may omit one of the extensions 516, 516'. In this circumstance, the first and second unlatching members 70 and 90 are able to actuate the retaining arms 51 and 51' for unlatching respectively.

Figure 14:
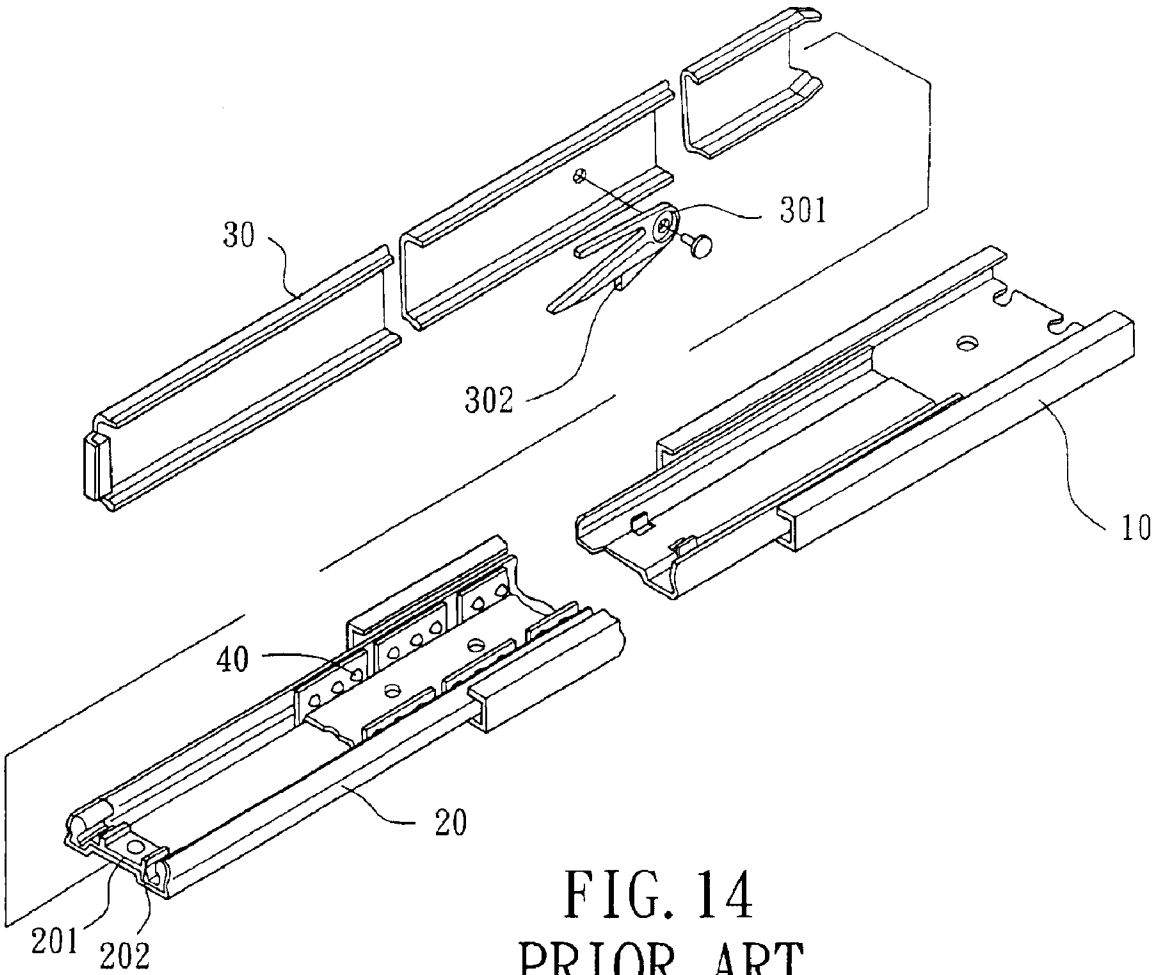
FIG. 14 PRIOR ART
FIG. 14 is an exploded perspective view of a conventional three-section slide track in accordance with the prior art.

Referring again to FIG. 14, the conventional three-section slide track is only provided with a retaining member 301 and a stop member 201 that only retains the slide track in one-way direction. The present invention accomplishes to retain the slide track in a two-way direction instead of the conventional one-way direction.

Although the invention has been described in detail with reference to its presently preferred embodiment, it will be understood by one of ordinary skill in the art that various modifications can be made without departing from the spirit and the scope of the invention, as set forth in the appended claims.

What is claimed is:

1. A two-way retainer for a slide track assembly, comprising:

a retaining mechanism mounted on a first slide track, the retaining mechanism including a pair of retaining arms and an elastic member, the retaining arms being pivotally connected to the first slide track, the retaining arm each being provided with an inclined portion and a first engaging portion, the elastic member being adapted to bias the retaining arms;

a stop member mounted on a second slide track and including a protrusion;

a first unlatching member movably mounted on the first slide track, and adapted to actuate at least one of the retaining arms;

wherein when the first slide track is moved to a predetermined position with respect to the second slide track, the protrusion of the stop member may pass through the inclined portions of the retaining arms and be confined within a space formed the first engaging portions to thereby retain the first slide track in a two-way direction of the second slide track.

2. The two-way retainer for a slide track assembly as defined in claim 1, wherein the first unlatching member is adapted to unlatch an engaged relationship of the first engaging portion with the protrusion and includes a grip, a pair of recessions and a pair of shoulders; and wherein the retaining arms each further comprises a step portion and a second engaging portion, the step portion being adapted to accommodate an unlatching operation of the first unlatching member, and the second engaging portion is adapted to engage with one of the pair of shoulders of the first unlatching member.

3. The two-way retainer for a slide track assembly as defined in claim 2, wherein the first unlatching member further comprises an elastic member adapted to provide a bias force for reciprocation on the first slide track.

4. The two-way retainer for a slide track assembly as defined in claim 3, wherein the first unlatching member includes a rod body adapted to be held in a holder, and a lug extended from the rod body and adapted to combine with the elastic member.

5. The two-way retainer for a slide track assembly as defined in claim 3, wherein the first unlatching member is arranged to directly actuate the two retaining arms for turning.

6. The two-way retainer for a slide track assembly as defined in claim 1, wherein the first unlatching member includes a single recession and a single shoulder; and one of the retaining arms is provided with a second engaging portion adapted to engage with the shoulder of the first unlatching member.

7. The two-way retainer for a slide track assembly as defined in claim 1, wherein the first unlatching member is arrange to move in a two-way direction or a one-way direction by a stop means.

8. The two-way retainer for a slide track assembly as defined in claim 1, wherein the first unlatching member is connected to one of the retaining arms so that when the first unlatching member is pulled to turn one of the retaining arms, the other retaining arm is turned synchronously.

9. The two-way retainer for a slide track assembly as defined in claim 1, wherein each of the retaining arms further comprises an extension, the extensions engaging each other; and wherein when one of the retaining arms is turned, the other retaining arm is turned synchronously.

10. The two-way retainer for a slide track assembly as defined in claim 1, wherein the protrusion of the stop member is integrated into an end of the second slide track.

11. The two-way retainer for a slide track assembly as defined in claim 1, wherein the retaining arms each further comprises a recession adapted to connect to the elastic member.

12. The two-way retainer for a slide track assembly as defined in claim 1, wherein the retaining mechanism further comprises a base adapted to position the elastic member on an inner side of the first slide track and wherein the elastic member is thereby located between the retaining arms.

13. The two-way retainer for a slide track assembly as defined in claim 1, further comprising a second unlatching member, the second unlatching member including a grip and a shoulder; and wherein one of the retaining arms further comprises a step portion and a third engaging portion, the step portion being adapted to accommodate the shoulder of the second unlatching member, and the third engaging portion being adapted to engage with the shoulder of the second unlatching member.

14. The two-way retainer for a slide track assembly as defined in claim 13, wherein the first unlatching member is adapted to actuate one of the retaining arms while the second unlatching member is adapted to actuate the other retaining arm.

15. The two-way retainer for a slide track assembly as defined in claim 13, wherein the second unlatching member employs a base adapted to limit movement.

16. The two-way retainer for a slide track assembly as defined in claim 15, wherein the base includes an elastic member adapted to engage with a lug extended from the second unlatching member for reciprocation.

* * * * *